US007191471B2

(12) United States Patent
Gadot et al.

(10) Patent No.: US 7,191,471 B2
(45) Date of Patent: Mar. 20, 2007

(54) ITEM OF APPAREL

(75) Inventors: Moshe Gadot, Rehovot (IL); Avraham Einhorn, Kiryat Gat (IL); Lia Sherban, Yavneh (IL); John Shaw Newton, London (GB); Raymond Archibald Walters, Herts (GB)

(73) Assignee: Bagir Co (1961) Ltd., Kiryat Gat ( * ) Notice: Subject to any disclaimer, the term of this patent is extended or adjusted under 35 U.S.C. 154(b) by 0 days.

(21) Appl. No.: 10/916,441

(22) Filed: Aug. 12, 2004

(65) Prior Publication Data

US 2005/0102728 A1 May 19, 2005

Related U.S. Application Data

(63) Continuation of application No. 10/125,419, filed on Apr. 19, 2002, now abandoned.

(51) Int. Cl.
*A41D 1/02* (2006.01)

(52) U.S. Cl. ..... 2/108; 2/85; 2/93

(58) Field of Classification Search ..... 2/69, 2/243.1, 85, 93, 97, 108, 247.94, 248.95, 2/255, 258, 272, 274, 275, 279
See application file for complete search history.

(56) References Cited

U.S. PATENT DOCUMENTS 1,573,302 A * 2/1926 Cohen ..... 2/247
3,446,658 A * 5/1969 Rose ..... 428/196
3,639,914 A * 2/1972 Ellman ..... 2/93
3,703,730 A * 11/1972 Miller ..... 2/272
3,769,819 A * 11/1973 Contreras ..... 68/213
4,141,082 A * 2/1979 Nakazawa et al. ..... 2/93
4,143,424 A * 3/1979 Knoke et al. ..... 2/255
4,214,319 A * 7/1980 Bollag ..... 2/108
4,490,425 A * 12/1984 Knoke et al. ..... 428/90

(Continued)

FOREIGN PATENT DOCUMENTS

DE 1908205 1/1965

(Continued)

OTHER PUBLICATIONS

Miller. "Textiles; Properties and Behaviour in Clothing Use", BT Batsford Ltd . London. pp. 110-113. 1992.

(Continued)

*Primary Examiner*—Gloria M. Hale
(74) *Attorney, Agent, or Firm*—Pearl Cohen Zedek Latzer, LLP

(57) ABSTRACT

A machine washable suit jacket or other tailored garment having a machine washable outer material with crease memory. Sections of the outer material may be sewn together with machine washable thread, and seams of such sections may have pucker preventing tapes fused to the back of the seams. The garment may have a machine washable heat fusible interfacing material that may be secured to the inner side of the garment by heat fusing. The garment may have a machine washable lining, sections of which may be joined by machine washable thread. The garment may have a pocket, that has a mouth running transversely to the length of the jacket, where the bag of the pocket is sewn to a seam of the garment sections, where the seam runs lengthwise to the garment.

22 Claims, 10 Drawing Sheets

U.S. PATENT DOCUMENTS

| | | | | |
|---|---|---|---|---|
| 4,521,921 | A * | 6/1985 | Bregatta | 2/93 |
| 5,044,013 | A * | 9/1991 | Ackerman | 2/144 |
| 5,153,049 | A | 10/1992 | Groshens | |
| 5,526,534 | A * | 6/1996 | Lazar | 2/97 |
| 5,669,072 | A * | 9/1997 | Bjorklund | 2/93 |
| 6,056,788 | A | 5/2000 | Rossler et al. | |

FOREIGN PATENT DOCUMENTS

| | | |
|---|---|---|
| DE | 7041234 | 11/1970 |
| DE | 8401944 | 5/1984 |
| DE | 8510513 | 5/1985 |
| DE | 3411084 | 1/1986 |
| DE | 9306255 | 6/1993 |
| DE | 9319870 | 6/1994 |
| EP | 0120706 | 10/1984 |
| EP | 0369046 | 5/1990 |
| EP | 0481867 | 4/1992 |
| EP | 0 894 442 | 2/1999 |
| EP | 0894442 | 2/1999 |
| EP | 1 232 697 | 8/2002 |
| FR | 2 763 799 | 12/1998 |
| FR | 2763799 | 12/1998 |
| GB | 2078670 | 1/1982 |
| GB | 2370214 | 3/2003 |
| GB | 2 401 302 | 11/2004 |
| JP | 1229880 | 9/1989 |
| JP | 665803 | 3/1994 |
| WO | WO 83/02750 | 8/1983 |

OTHER PUBLICATIONS

Carr et al., "Alternative Methods of Joining Materials", The Technology of Clothing Manufacture, Oxford Blackwell Scientific Publications, Second Edition, pp. 194-222; 1994.

Haensel Technical Data Sheet 4042/BS6; 1997.

Polgat Textiles Fabric Test Results for Quality 89216-111; 1995.

Polgat Textiles Fabric Test Results for Quality 84960-2056; 1993.

European Search Report for EP 05 00 1150 dated Jun. 27, 2005.

* cited by examiner

ITEM OF APPAREL

CROSS REFERENCE TO RELATED APPLICATIONS

This application is a continuation of U.S. patent application Ser. No. 10/125,419, filed Apr. 19, 2002, now abandoned, The invention relates to an item of apparel, such as a jacket, in particular a man's jacket or suit jacket.

Men's suits whilst still being bespoke tailored, are increasingly made by mass production techniques. Such techniques lend such suits to be sold relatively inexpensively in retail outlets such as department stores. However, suits have to be cleaned. Cleaning, particularly dry cleaning is relatively expensive, and has to be repeated several times over the life of the suit, so increasing its overall cost.

Various proposals have been made for making machine-washable suits but such known suits were not able to retain their smartness after being subjected to a number of wash cycles.

It is an object of the invention to provide a machine-washable item of apparel, which is able to retain its smartness after being subjected to machine washing.

The invention concerns a machine-washable item of apparel comprising a plurality of garment sections of a first, outer material, said first, outer material being a machine-washable fabric having a crease memory, said garment sections being joined to each other by sewn seams using machine-washable thread; a plurality of sections of a second, interfacing material, said second interfacing material being a machine-washable, fusible interfacing material, said sections of said second, interfacing material being secured to the inner side of selected ones of said garment sections by heat fusing thereto; and a plurality of sections of a third, lining material, said third, lining material being a machine-washable lining material, said lining sections being joined to each other by sewn seams using machine-washable thread, and said joined lining sections being secured on the inner side of said joined garment sections.

According to the invention, various features can be used singly or in combination to achieve very superior results on machine washing.

According to a first aspect of the invention, there is provided an item of apparel, such as a suit jacket, comprising a fabric which is washable and has a crease memory whereby on washing, the item of apparel is not substantially creased.

The item of apparel may comprise styling inserts between the fabric and the lining of the item of apparel, and adhesive(s) and thread(s) used in construction of the item of apparel, which are machine-washable.

Thus on washing, the shape of the item is maintained, and its appearance after washing is much better than could be achieved without the invention.

Edges of the styling inserts may be over-locked to obviate fraying. In particular, edges of machine-washable canvas chest and sleeve inserts may be over-locked.

The edges of the lining material may be over-locked to obviate fraying. This, as with chest and sleeve inserts, assists in maintaining the original styling and hence shape of the item after a wash.

There may be at least one pocket, an inner bag of which may be secured to an adjacent seam to obviate creasing during washing. This avoids unsightly creasing in the wash, particularly when the inner pocket bag may be a breast pocket bag secured to a facing seam by sewing.

There may be two pockets which may comprise front pockets each inner bag of which may be secured to a side seam by a tape sewn into that side seam.

Facings of the item may be stitched to fronts by a blind stitch, to obviate creasing during washing. The blind stitch avoids puckering.

Long seams may be secured with fused tapes to obviate puckering after a wash. The fused tapes may comprise the adhesive which may have a peel strength of not less than 20 N/5 cm.

The adhesive melt temperature may be in the range 130° C.–140° C., particularly about 135° C. This provides a secure fixing whilst obviating puckering and creasing in a wash cycle.

The fabric may comprise a wool and synthetic fabric mixture, in particular a wool and polyester mixture, such as 50% or more polyester, particularly a polyester/wool/LYCRA™SPANDEX™ mixture, preferably comprising 55% polyester, 43% wool and 2% LYCRA™SPANDEX™. This provides a suitable machine-washable, non-creasing item of apparel, which may suitably be a man's jacket.

According to another embodiment of the invention there is provided a combination comprising an item of apparel, as hereinbefore defined, and a laundering bag into which the item is placed for washing.

The laundering bag may have a central closable opening through which the item is inserted. Thus when so inserted and laid flat in the bag, the item of apparel is maintained substantially flat during washing, and this, with the features hereinbefore described, helps to obviate creasing during washing.

Thus using the invention it is possible to wash say a man's suit including the jacket, in a washing machine.

An item of apparel, in the embodiment a man's suit jacket, is hereinafter described, by way of example, with reference to the accompanying drawings, in which.

Figure 1A:
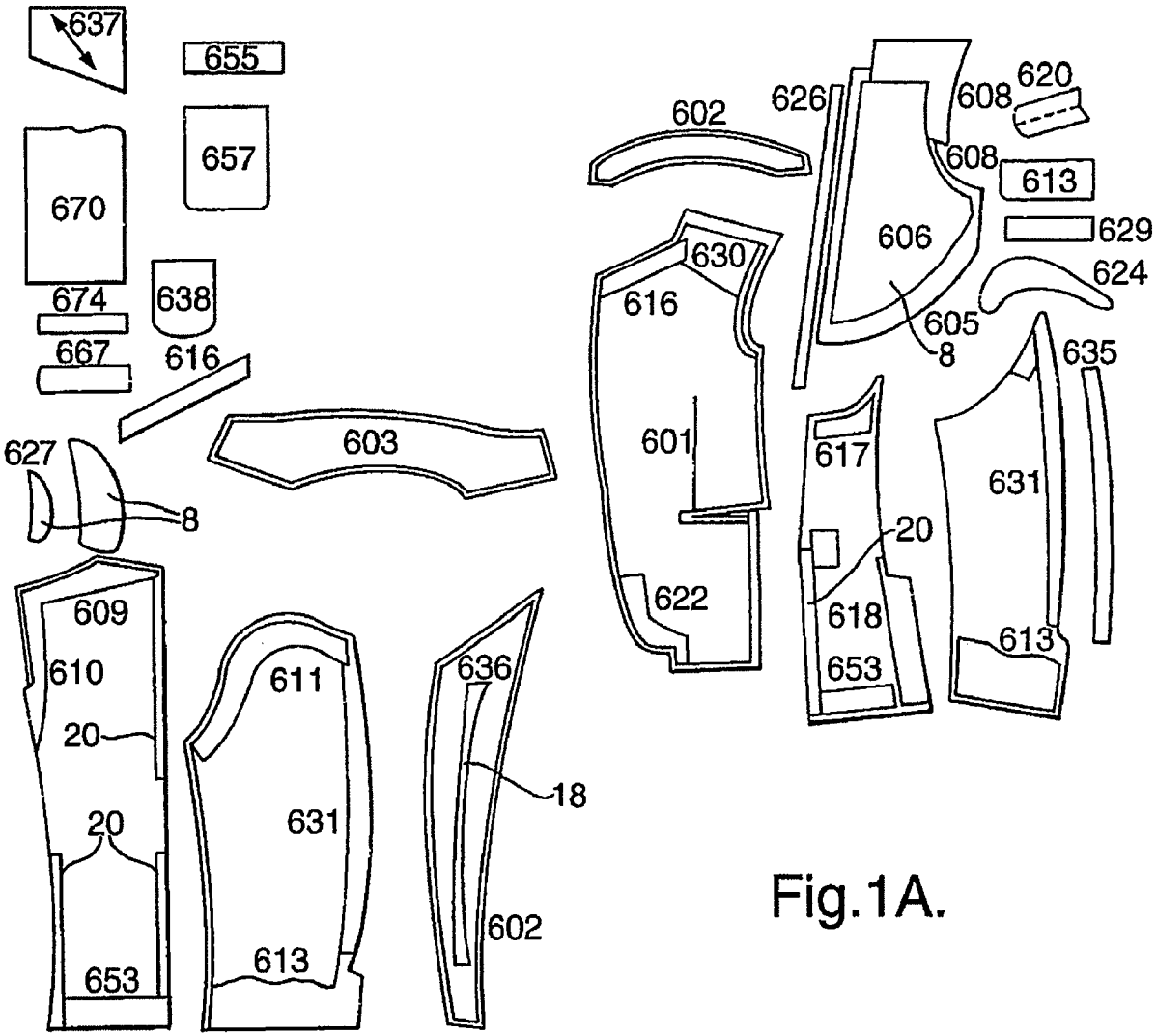
FIG. 1A shows schematically elevations of style inserts or trim, used in the manufacture of the suit jacket of FIG. 1.
Figure 1:
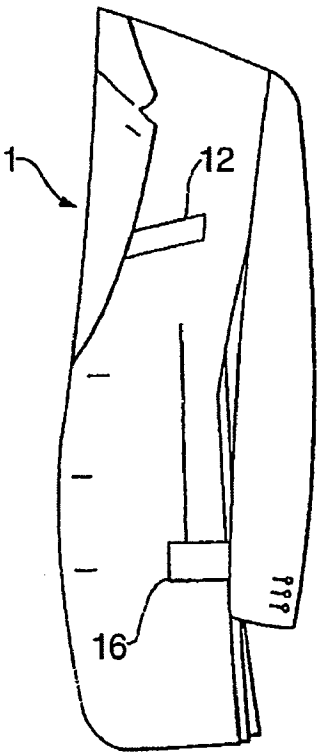
FIG. 1 is a side view of a jacket according to the invention.

Referring to the drawings, there is shown an item of apparel, in the embodiment a man's jacket 1 of a man's suit, comprising a fabric which is machine-washable and has a crease memory whereby on washing, the jacket 1 is not substantially creased.

The jacket 1 is machine-washable and comprises a plurality of garment sections of a first, outer material. The said first, outer fabric is a machine-washable fabric having a crease memory. The fabric has a crease memory in the sense that desired creases are retained whereas smooth, non-creased areas remain smooth and non-creased. The crease memory is achieved by the inclusion of synthetic material, in particular polyester, particularly at least 30% polyester, more preferably at least 50% polyester, in the material of the outer fabric. A suitable material is, for example, of weight 246 gr/m2 made of 60% wool, 37% polyester and 3% LYCRA™SPANDEX™. The said garment sections are joined to each other by sewn seams using commercially-available machine-washable thread.

The general cutting out and sewing together of the garment sections follows conventional garment construction practice and does not therefore need to be described in further detail.

The jacket 1 also includes a plurality of sections of a second, interfacing material. The interfacing material is a machine-washable, fusible interfacing material, in particular a synthetic material coated on one side with a heat-fusible adhesive. A suitable material is, for example, a 100% polyester material of weight 85 gm/$m^2$ with elastic warp and elastic weft coated with fine microdots of fusible adhesive. The sections of said second, interfacing material are secured to the inner side of selected ones of said garment sections by heat fusing thereto.

The jacket also includes a plurality of sections of a third, lining material. The third, lining material is a machine-washable lining material, for example, a 100% polyester material. The said lining sections are joined to each other by sewn seams using machine-washable thread. The said joined lining sections are secured on the inner side (that is the interior or wearer's body side) if said joined garment sections.

According to the invention, a number of measures are taken to increase the crease memory of the jacket to make it able to retain a smart appearance after machine washing.

According to one aspect of the invention, the crease memory is enhanced by the styling inserts or trim between the lining of the jacket, and the adhesive(s) and the machine-washable thread(s) used in construction of the jacket.

Figure 2:
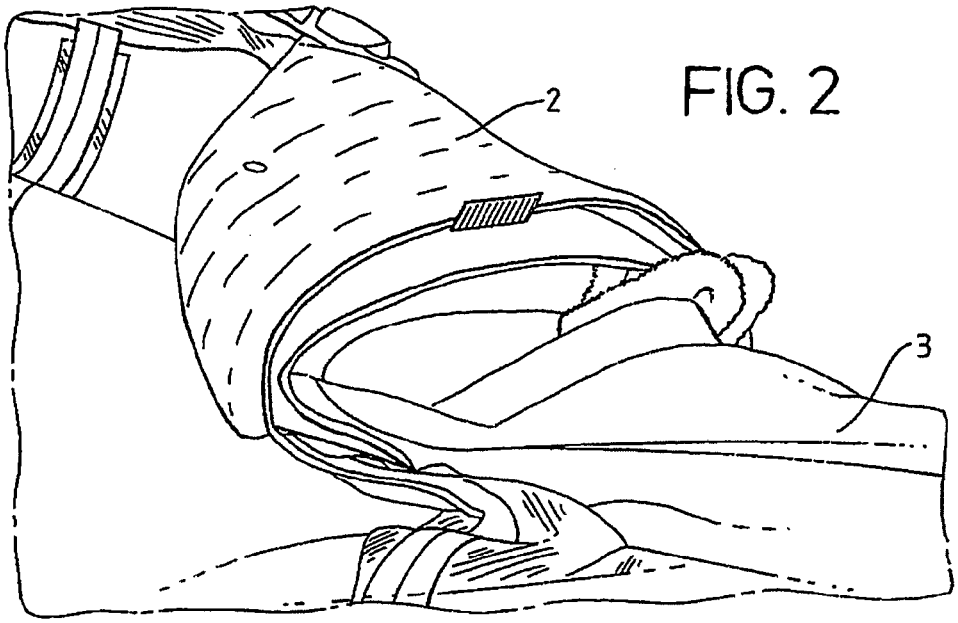
FIGS. 2 and 2A show schematically different perspective views, to a larger scale than FIGS. 1 and 1A, of style inserts in the form of machine-washable shoulder pads of the jacket.
Figure 2A:
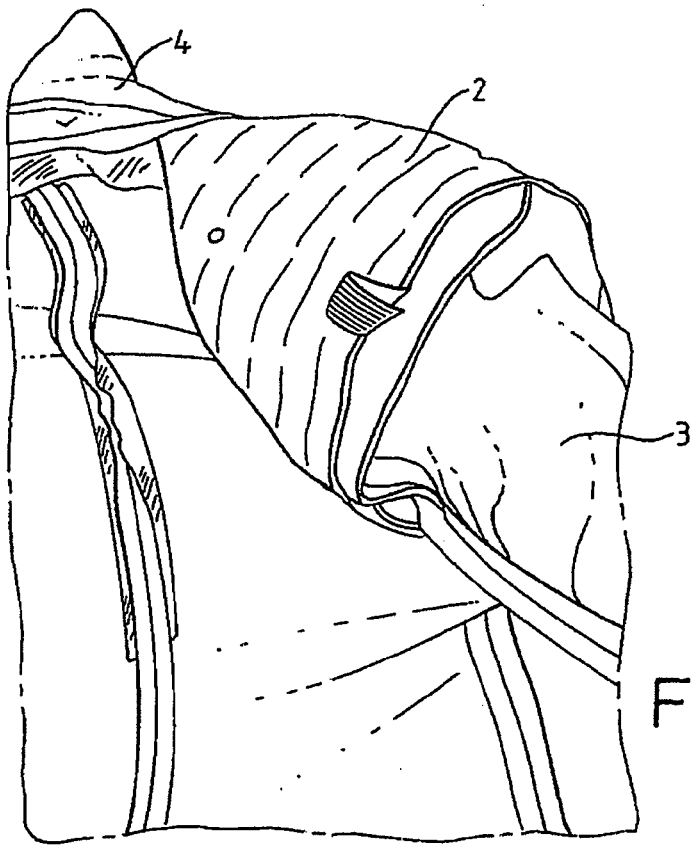

Thus FIGS. 2 and 2A show washable shoulder pads 2 which are inserted between the lining 4 and the fabric 3. Another, and preferred, example of a suitable outer fabric 3 for the jacket 1 is a mixture of polyester, wool and LYCRA™SPANDEX™ in the proportions 55%, 43% and 2%.

Figure 3:
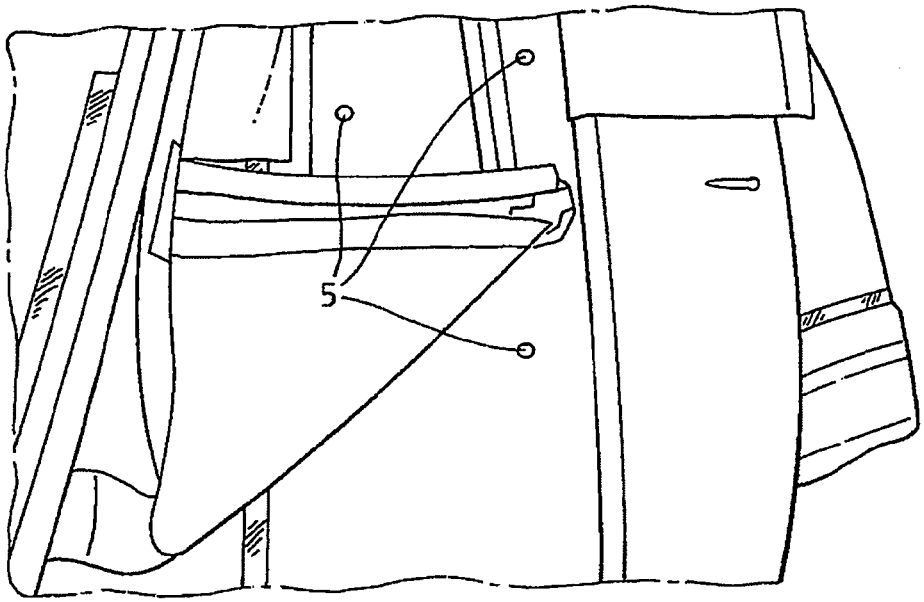
FIG. 3 shows schematically machine-washable fusible materials of the jacket of FIGS. 1 and 1A. and to a larger scale than those figures.
Figure 3:
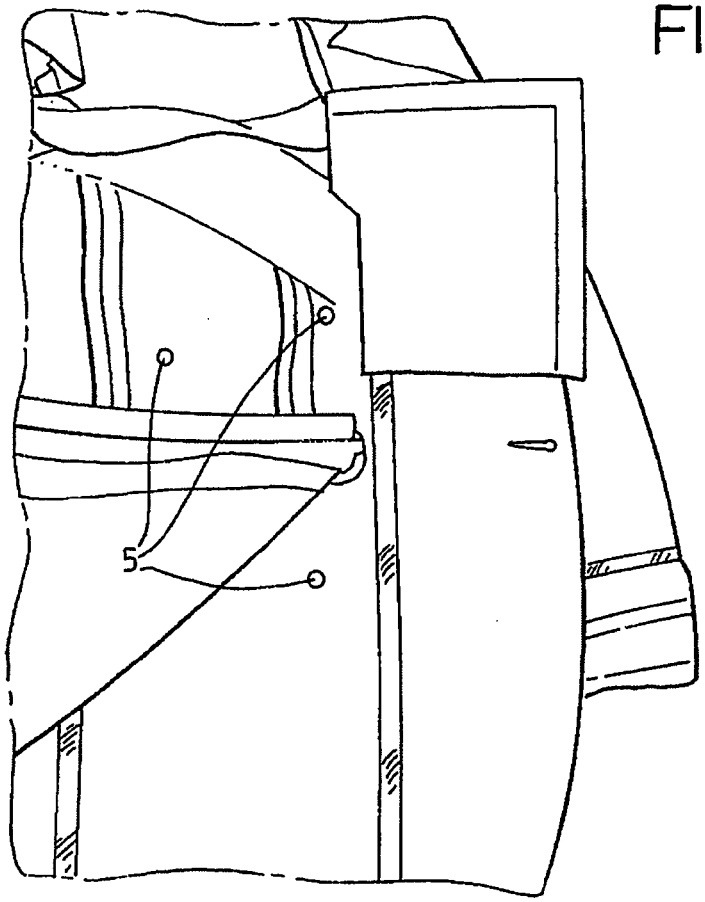
Figure 4:
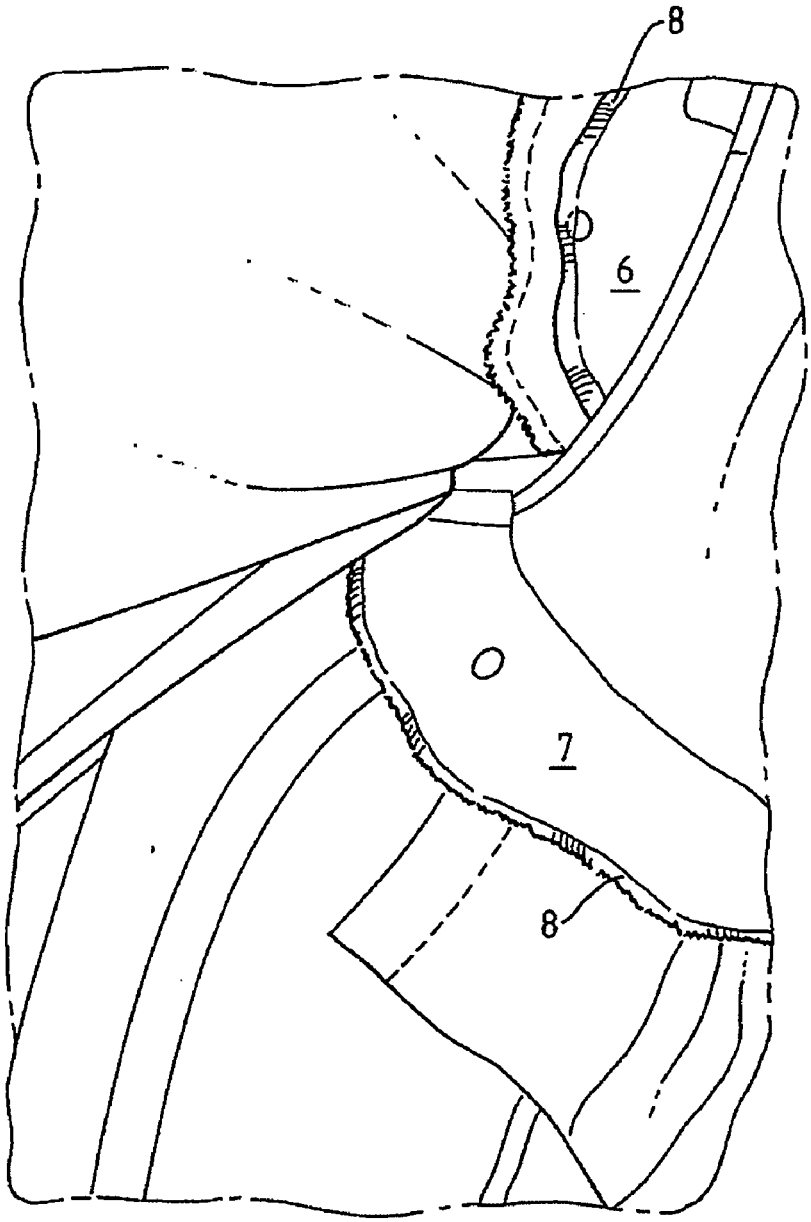
FIG. 4 shows schematically chest and sleeve style inserts in the form of machine-washable canvas trim of the suit of FIG. 1, and locked over edges of the canvas to avoid fraying.

FIG. 3 shows machine-washable fusible or fusing materials 5 while FIG. 4 shows style inserts in the form of chest and sleeve trim 6, 7 made, in the embodiment, of machine-washable canvas, the edges of which are secured against fraying by over-locked stitches 8 in the embodiment.

Figure 5:
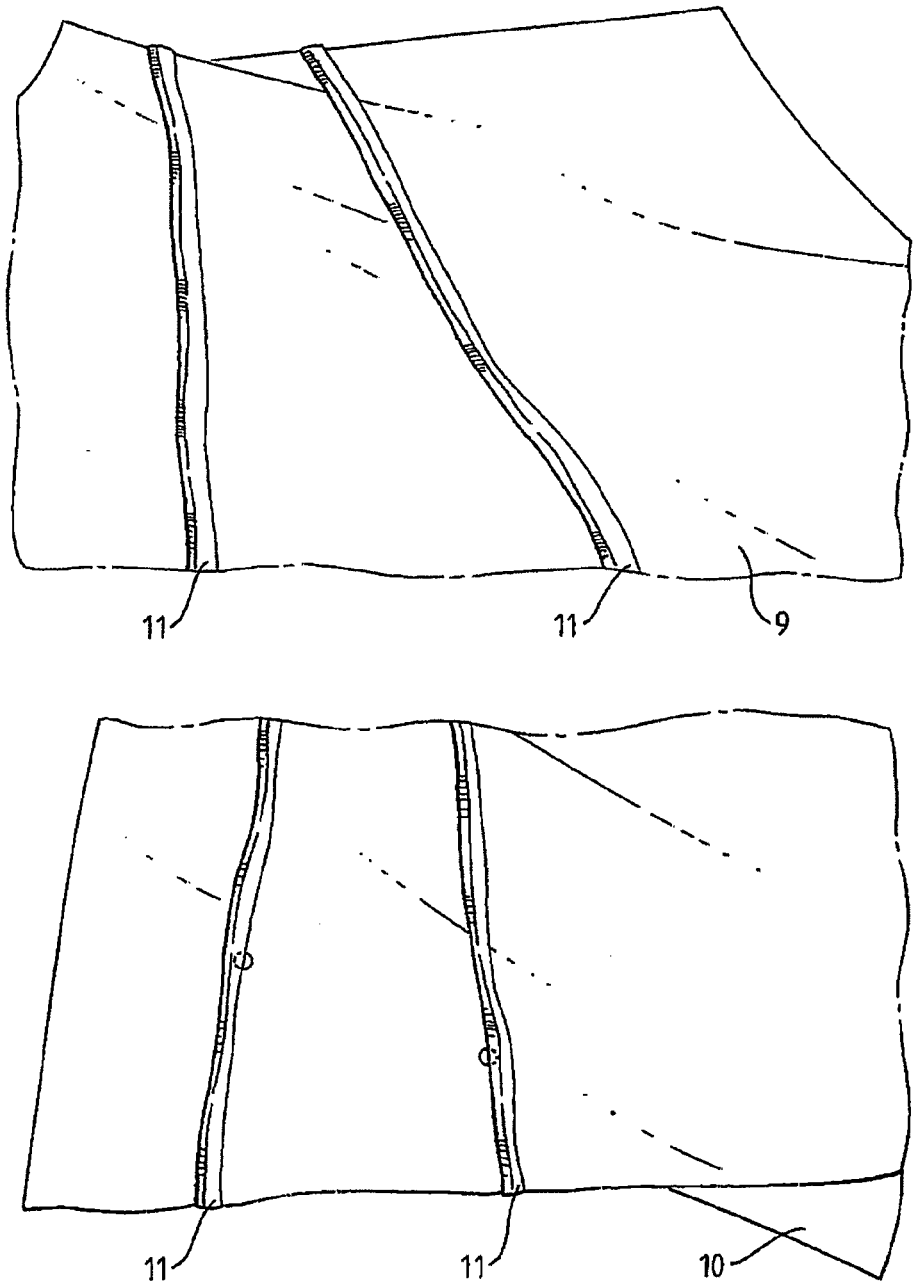
FIG. 5 shows schematically two parts or sections of lining of the suit, the edges of which are locked over to obviate fraying.

FIG. 5 shows different parts or sections 9, 10 of the lining of the jacket, the edges of which are also secured against fraying by over-locked stitches 11 in the embodiment.

Figure 6:
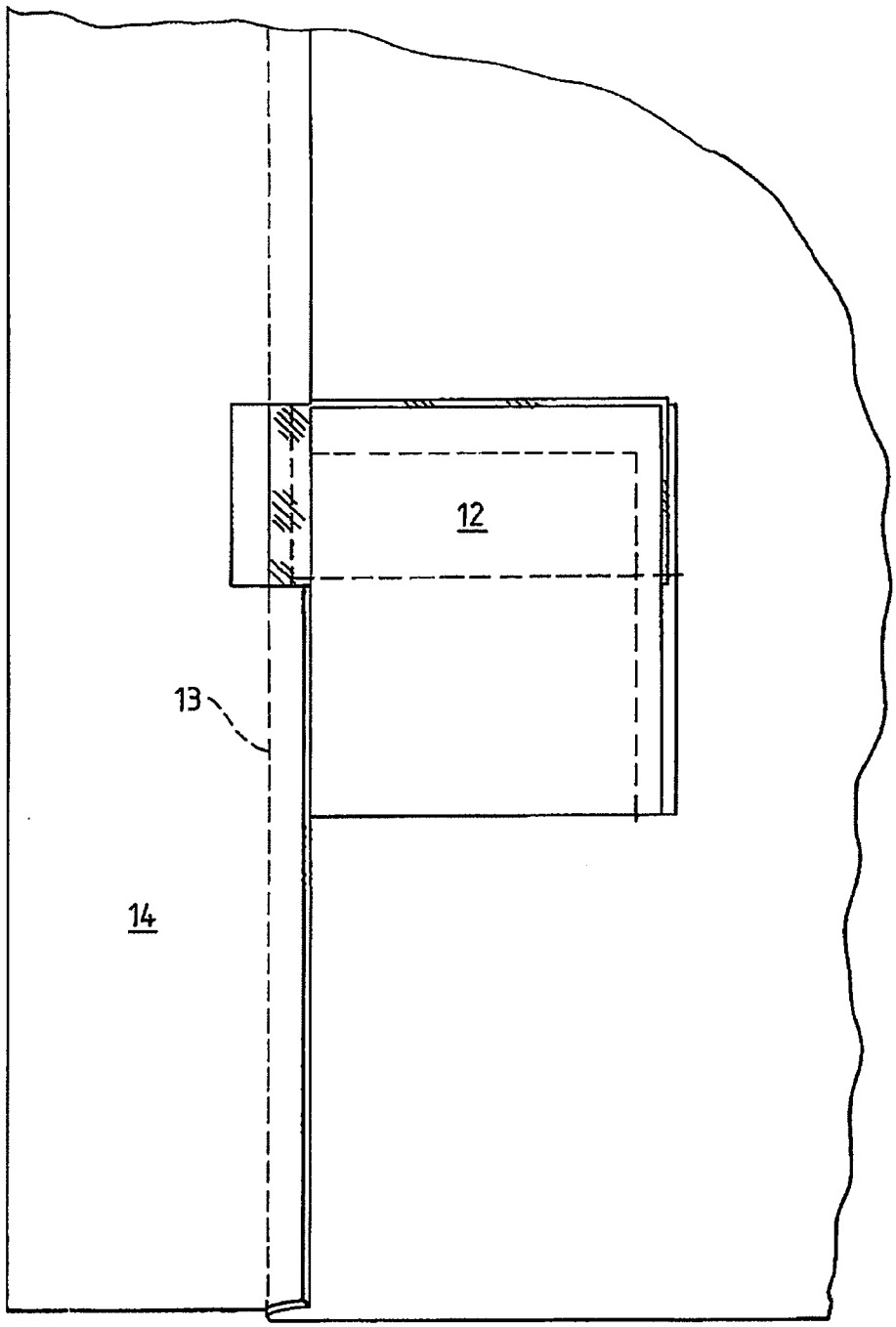
FIG. 6 shows schematically in elevation a chest or in breast pocket bag sewn into a facing seam to obviate creasing during a wash.
Figure 7:
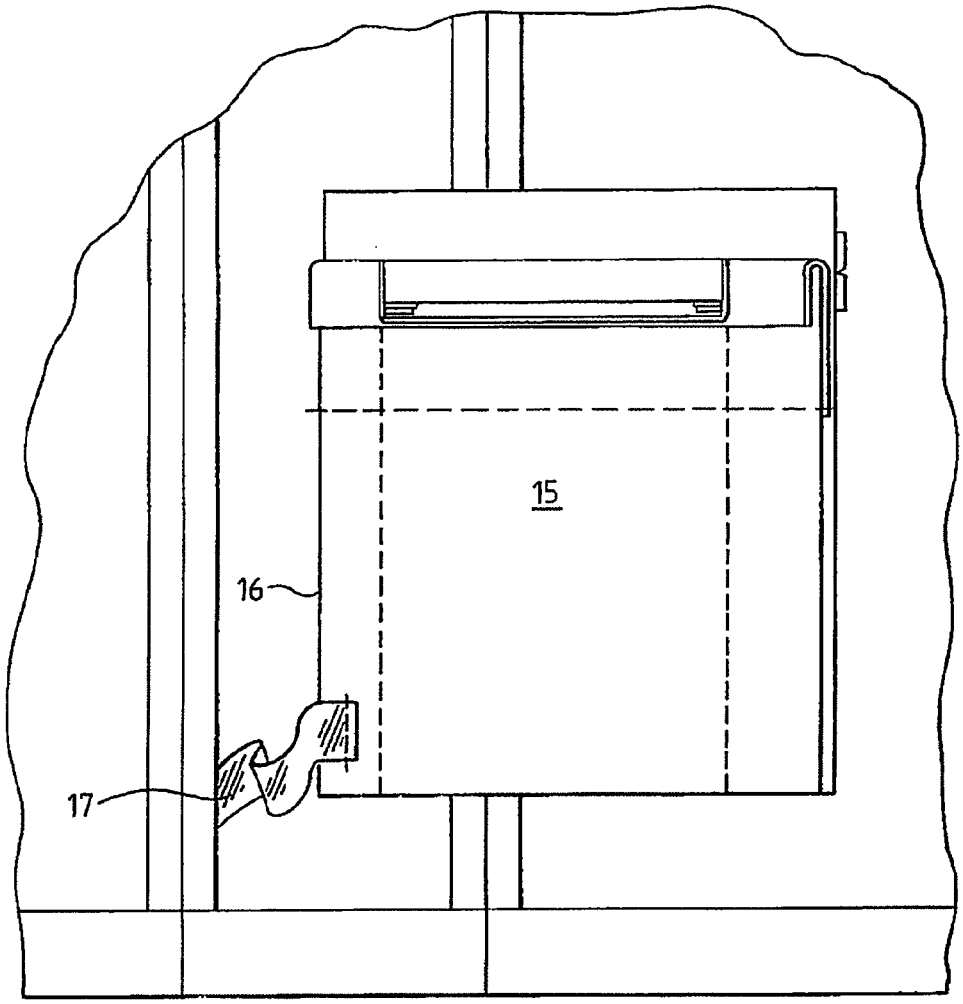
FIG. 7 shows schematically in elevation, front pocket bags secured with tapes sewn into the side seams in order to avoid creasing during a wash.

Turning now to FIG. 6, a chest or breast pocket 12 of the suit jacket 1 has an inner bag 12 defining the pocket and which is sewn into a seam 13 of the facing 14 in order to obviate creasing during a wash. As seen in the drawings, the mouth of the pocket 12 runs transverse to the length of the jacket and the seam 13 runs along the length of the jacket. In a similar manner, the lower ends of inner bags 15 of front pockets 16 are secured with a tape 17 sewn into the side seam in order to avoid creasing during a wash (FIG. 7). The tape(s) 17 hold the side pocket inner bags 15 in place and are long enough to allow for movement, so avoiding creasing. One or more so-called "inside pockets" where the mouth of the pockets opens to the exterior surface of the lining (the inside of the jacket) can be provided in a similar manner.

Figure 8:
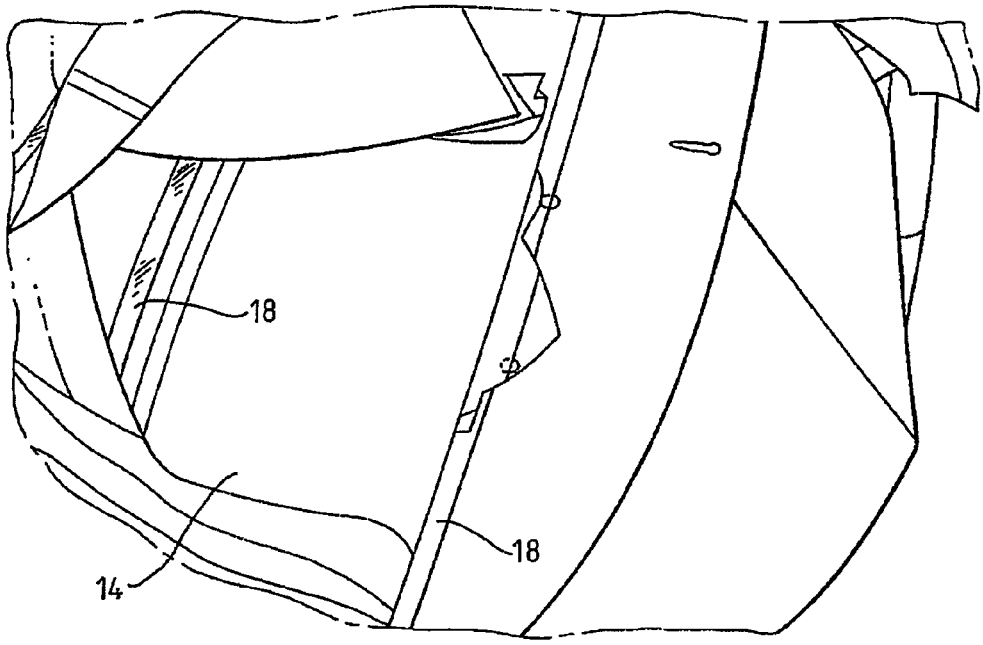
FIG. 8 shows schematically in elevation style inserts in the form of facings secured to fronts by blind stitches.
Figure 9:
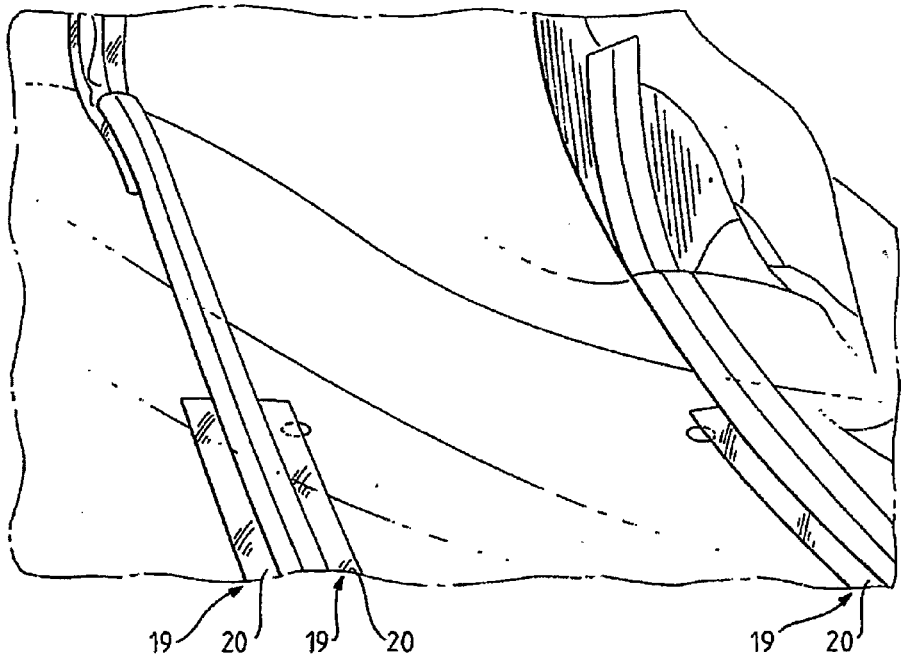
FIG. 9 shows schematically long seams secured with fused tapes to obviate puckering after a wash.

Turning now to FIG. 8, there are shown style inserts in the form of facings 14 secured by stitching to the fronts using blind stitches 18, while FIG. 9 shows long seams 19 secured with machine-washable fused tapes 20 to obviate puckering after a wash.

Figure 10A:
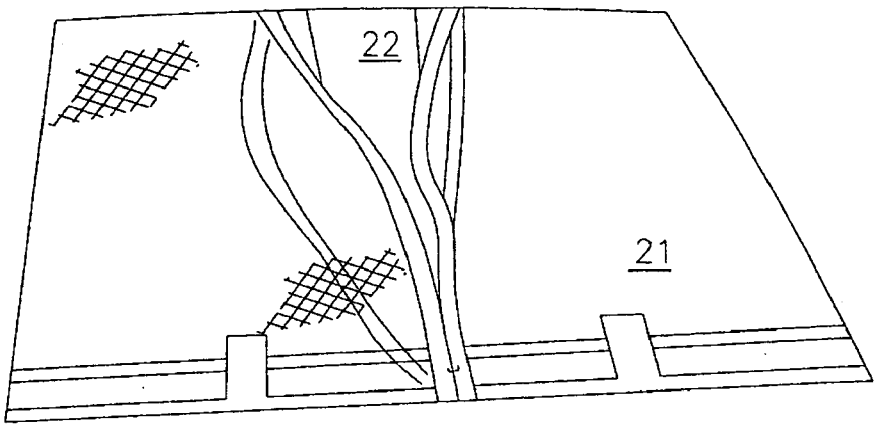
FIGS. 10 and 10A show respectively an elevation and a plan view of a washing bag and a stowing bag in which the washing bag is stowed.
Figure 10:
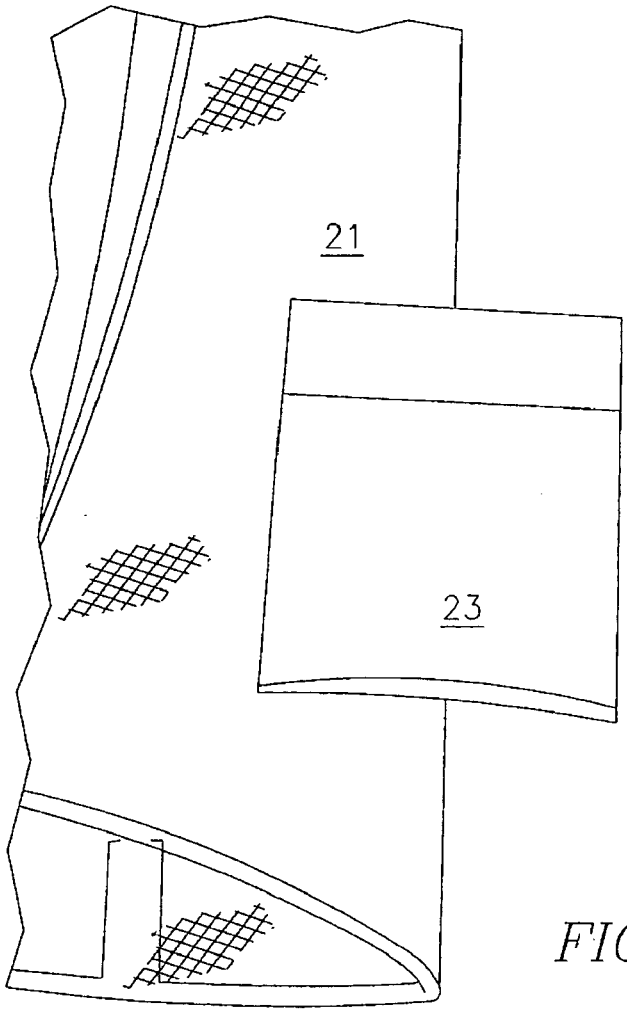

FIG. 10 shows a wash bag 21 made of synthetic material readily permeable to washing water. The wash bag 21 is of sufficient size for the item of apparel to be stowed and laid flat on it, prior to closing as by zipping up a central opening 22 through which the apparel is inserted, the wash bag 21 being closed which maintains the item flat so that it can be placed in a washing machine and subjected to a wash cycle, whereafter the suit emerges relatively uncreased, the wash bag 21 being a mesh bag to allow for full circulation of washing medium.

The wash bag 21 is housed when not in use in a stowing bag 23.

During manufacture of the suit jacket 1, fusing machines used to fuse the adhesive are set to provide a desired peel strength, which in the embodiment is no less than 20N/5 cm. The adhesive/glue temperature should preferably be 135° C. in the embodiment. Also, after manufacture, the suit jacket 1 is pressed for a period of time which adds relaxation and vacuum time in order to achieve a substantially flat press of the jacket, in which shoulder reinforcements are inclined at an angle of 15°.

Reverting to FIG. 1A, details of styling inserts and fusible components used in the construction of the jacket 1 are identified in the following list by reference numerals starting at 601:

601 fusible interfacing section for jacket front of jacket
602 lapel and "banana" insert
615 fusible interfacing section for pocket flap
629 fusible interfacing for pocket jet
603 insert for the collar
609 insert for the shoulder
611 insert for the top upper of a sleeve
617 side part for the arm pit
618 fusible interfacing for the jacket vent
610 back part for the arm pit
605 chest piece of machine-washable canvas
606 fusible interfacing for the jacket chest
608 reinforcing section for the chest of the jacket
613 fusible interfacing for sleeve of the jacket
636 reinforcing section for use in the lapel of a double-breasted jacket
616 upper marking fusible interfacing
635 reinforcing section for back length of jacket
620 chest pocket
674 pockets (no fusing) of flieselin
624 helzaflex (vatellina)
653 hem
657 flieselin for patch pocket
655 reinforcing section for patch pocket reinforcement
670 flieselin for side part
667 fusible interfacing for front darts
627 ambassador (machine-washable sleeve canvas)
638 chest pocket

631 fusible interfacing for back of sleeve
622 lower marking fusible interfacing
630 shoulder reinforcement 15°
626 chest piece tape 20 mm Although a detailed description of a jacket according to the invention has been given, the invention can also be supplied to a different item of apparel, for example, a pair of trousers, in particular, a matching pair of trousers for the described suit jacket.

What is claimed is:

1. A machine-washable suit jacket comprising:

a plurality of garment sections of a first, outer material, said first, outer material being a machine-washable fabric having a crease memory, said garment sections being joined to each other by sewn seams using machine-washable thread;

a plurality of pucker-preventing tapes secured by fusing to a back of at least a portion of each of said sewn seams of said garment sections;

a plurality of sections of a second, interfacing material, said second interfacing material being a machine-washable, fusible interfacing material, said sections of said second, interfacing material being secured to an inner side of selected ones of said garment sections by heat fusing thereto;

a plurality of sections of a third, lining material, said third, lining material being a machine-washable lining material, said lining sections being joined to each other by sewn seams using machine-washable thread, and said joined lining sections being secured on an inner side of said joined garment sections.

2. A machine washable jacket as set forth in claim 1, wherein the peel strength of parts fused to said outer material is at least 20 N/5 cm.

3. A machine-washable suit jacket as set forth in claim 1, wherein at least one pocket comprising a bag of pocket material is provided in a space between said joined garment sections and said joined lining sections, said pocket having a mouth opening externally, said pocket mouth running transversely relative to a length of said jacket, and said bag being secured by sewing to a selected one of said seams joining said garment sections, said selected seam running generally along the length of said jacket.

4. A machine-washable suit jacket as set forth in claim 1, further including a plurality of styling inserts selected from one or more of the group consisting of machine-washable shoulder pads, chest trim and sleeve trim, wherein said styling inserts are made of machine-washable material and having edges which are over-locked with machine-washable thread to obviate fraying.

5. A machine-washable suit jacket as set forth in claim 1, wherein said outer material comprises a wool and synthetic fabric mixture and said interfacing material and said lining material comprise 100% synthetic material.

6. A machine-washable suit jacket comprising:

a plurality of garment sections of a first, outer material, said first, outer material being a machine-washable fabric containing more than 30% polyester, said garment sections being joined to each other by sewn seams using machine-washable thread;

a plurality of sections of a second, interfacing material, said second interfacing material being a machine-washable, fusible interfacing material, said sections of said second, interfacing material being secured to an inner side of selected ones of said garment sections by heat fusing thereto;

a plurality of sections of a third, lining material, said third, lining material being a machine-washable lining material, said lining sections being joined to each other by sewn seams using machine-washable thread, and said joined lining sections being secured on an inner side of said joined garment sections; and at least one pocket comprising a bag of pocket material provided in a space between said joined garment sections and said joined lining sections, said pocket having a mouth running transversely relative to a length of said jacket, and said bag being secured by sewing to a selected one of said seams joining said garment sections, said selected seam running generally along the length of said jacket.

7. A machine-washable suit jacket as set forth in claim 6, wherein said at least one pocket is a breast pocket and is secured to a facing seam by sewing.

8. A machine-washable suit jacket as set forth in claim 6, wherein a plurality of pucker-preventing tapes are secured by fusing to a back of at least a portion of each of said sewn seams of said garment sections.

9. A machine-washable suit jacket comprising:

a plurality of garment sections of a first, outer material, said first, outer material being a machine-washable fabric having a crease memory, said garment sections being joined to each other by sewn seams using machine-washable thread;

a plurality of sections of a second, interfacing material, said second interfacing material being a machine-washable, synthetic interfacing material, said sections of said second, interfacing material being secured to an inner side of selected ones of said garment sections by heat fusing thereto;

a plurality of sections of a third, lining material, said third, lining material being a machine-washable lining material, said lining sections being joined to each other by sewn seams using machine-washable thread, and said joined lining sections being secured on an inner side of said joined garment sections; and at least one pocket comprising a bag of pocket material provided in a space between said joined garment sections and said joined lining sections, said pocket having a mouth opening externally, said mouth running transversely relative to the length of said jacket, and said pocket bag being secured to a selected one of said seams joining said garment sections, said selected seam being a side seam and the pocket bag of said at least one pocket being secured to said side seam by a tape sewn into said side seam.

10. A machine-washable jacket as set forth in claim 9, wherein said mouth opens in said outer fabric.

11. A machine-washable jacket as set forth in claim 9, wherein two front pockets are provided and the pocket bag of each of said two front pockets is secured to a respective adjacent side seam by a respective tape sewn into that side seam.

12. A machine-washable jacket as set forth in claim 11, further including a plurality of styling inserts selected from one or more of the group consisting of machine-washable shoulder pads, chest trim and sleeve trim, wherein said styling inserts are made of machine-washable material and having edges which are over-locked with machine-washable thread to obviate fraying.

13. A machine-washable jacket as set forth in claim 11, further comprising at least one pocket comprising a bag of pocket material provided in the space between said joined garment sections and said joined lining sections, said pocket having a mouth opening externally, said mouth running transversely relative to a length of said jacket, and said bag being secured by sewing to a selected one of said seams joining said garment sections, said selected seam running generally along the length of said jacket.

14. A machine-washable item of wearing apparel comprising:

a plurality of garment sections of a first, outer material, said first, outer material being a machine-washable fabric selected from the group consisting of a wool and polyester mixture with at least 30% polyester, a wool and polyester mixture with at least 50% polyester, and a wool polyester and spandex mixture, said garment sections being joined to each other by sewn seams using machine-washable thread;

a plurality of pucker-preventing tapes secured to a back of at least a portion of each of said sewn seams of said garment sections;

a plurality of sections of a second, interfacing material, said second interfacing material being a machine-washable, fusible interfacing material, said sections of said second, interfacing material being secured to an inner side of selected ones of said garment sections by heat fusing thereto with a peel strength of at least 20 N/5 cm; and a plurality of sections of a third, lining material, said third, lining material being a machine-washable polyester lining material, said lining sections being joined to each other by sewn seams using machine-washable thread, and said joined lining sections being secured on the inner side of said joined garment sections.

15. A machine-washable item as set forth in claim 14, further including at least one pocket comprising a bag of pocket material provided in space between said joined garment sections and said joined lining sections, said pocket having a mouth opening in said outer fabric, and said pocket bag being secured by a connection selected from the group consisting of sewing to a selected one of said seams joining said garment sections, and securing to one of said seams by a tape sewn into that seam.

16. A machine-washable item of wearing apparel as set forth in claim 14, wherein said item is a suit jacket.

17. A machine-washable jacket as set forth in claim 16, further including a plurality of styling inserts selected from one or more of the group consisting of machine-washable shoulder pads, chest trim and sleeve trim, wherein said styling inserts are made of machine-washable material and having edges which are over-locked with machine-washable thread to obviate fraying.

18. A machine-washable jacket as set forth in claim 16 in combination with a laundering bag to launder said jacket, said laundering bag comprising a bag of material readily permeable to washing water, said laundering bag having an opening through which the jacket can be inserted, said laundering bag being of a size sufficient to hold said jacket within it, and said laundering bag being provided with a closure for said opening.

19. A machine-washable jacket as set forth in claim 18 and laundering bag to launder said jacket, wherein said laundering bag is made of a mesh material and said closure is a zip closure.

20. A machine-washable jacket as set forth in claim 16, wherein said jacket comprises facings stitched to a front of said jacket by blind stitching using machine-washable thread.

21. A machine-washable item as set forth in claim 14, wherein an edge of said lining material has edges which are over-locked with machine-washable thread to obviate fraying.

22. A machine-washable item as set forth in claim 14, wherein parts of the item secured by heat fusing are heat fused using an adhesive having a melt temperature in the range 130° to 140° C.

* * * * *